US011598027B2

(12) United States Patent
Bivens et al.

(10) Patent No.: US 11,598,027 B2
(45) Date of Patent: Mar. 7, 2023

(54) METHODS AND SYSTEMS FOR FORMING A COMPOSITE YARN

(71) Applicant: Patrick Yarn Mills, Inc., Kings Mountain, NC (US)

(72) Inventors: Max Bivens, Belmont, NC (US); Gilbert Patrick, Kings Mountain, NC (US)

(73) Assignee: PATRICK YARN MILLS, INC., Kings Mountain, NC (US)

( * ) Notice: Subject to any disclaimer, the term of this patent is extended or adjusted under 35 U.S.C. 154(b) by 401 days.

(21) Appl. No.: 16/718,738

(22) Filed: Dec. 18, 2019

(65) Prior Publication Data

US 2021/0189609 A1 Jun. 24, 2021

(51) Int. Cl.

| | |
|---|---|
| ***D02G 3/18*** | (2006.01) |
| ***D02G 3/36*** | (2006.01) |
| ***D02G 3/38*** | (2006.01) |
| ***D03D 15/267*** | (2021.01) |

(52) U.S. Cl.

CPC ..... *D02G 3/185* (2013.01); *D02G 3/367* (2013.01); *D02G 3/38* (2013.01); *D03D 15/267* (2021.01); *D10B 2101/06* (2013.01); *D10B 2321/021* (2013.01)

(58) Field of Classification Search

CPC ..... D02G 3/185; D02G 3/367; D02G 3/38; D02G 3/36; D02G 3/28

USPC ..... 57/224, 236

See application file for complete search history.

(56) References Cited

U.S. PATENT DOCUMENTS

| | | | | |
|---|---|---|---|---|
| 2,317,910 A * | 4/1943 | Hill | D03D 25/00 139/408 |
| 2,346,759 A * | 4/1944 | Jackson | D02G 3/28 57/236 |
| 2,901,884 A * | 9/1959 | Weinberger | D02G 3/367 57/211 |
| 3,474,614 A | 10/1969 | Gallina | |

(Continued)

FOREIGN PATENT DOCUMENTS

| | | | |
|---|---|---|---|
| CN | 112458582 A * | 3/2021 | D02G 3/36 |
| DE | 19804341 A1 * | 8/1999 | D02G 3/367 |

(Continued)

OTHER PUBLICATIONS espacenet.com; Machine Translation; UK NII Tekstilnoj Promy; SU-1015008-A1; 1983.

(Continued)

*Primary Examiner* — Khoa D Huynh
*Assistant Examiner* — Grace Huang

(57) ABSTRACT

A method and system for forming composite yarns having selected performance characteristics including cut resistance and/or fire/heat resistance. The composite yarn will include a core of one or more filaments and a fiber bundle wrapped about the core and integrated with one or more additional filaments that help bind the fibers about the core. An additional filament or other composite yarn can be plied together therewith to form the finished composite yarn. The core filament(s) will be selected from cut and/or fire/heat resistant materials, while the fibers of the fiber bundle and the additional filament(s) wrapped about the core can be selected from natural or synthetic fibers or filaments having additional desired properties.

15 Claims, 4 Drawing Sheets

(56) References Cited

U.S. PATENT DOCUMENTS 4,466,331 A * 8/1984 Matheson ..... D04G 1/00 87/12
4,840,021 A * 6/1989 Guevel ..... D02G 3/367 57/210
4,897,989 A * 2/1990 Gray ..... D03D 27/00 57/236
4,921,756 A 5/1990 Tolbert et al.
4,936,085 A 6/1990 Kolmes et al.
5,119,512 A 6/1992 Dunbar et al.
5,177,948 A 1/1993 Kolmes et al.
5,285,623 A * 2/1994 Baillievier ..... D07B 1/062 57/236
5,319,950 A 6/1994 Whitt et al.
5,497,608 A * 3/1996 Matsumoto ..... D02G 3/38 57/2
5,506,043 A 4/1996 Lilani
5,572,860 A * 11/1996 Mitsumoto ..... D04B 1/106 57/224
5,597,649 A 1/1997 Sandor et al.
5,632,137 A 5/1997 Kolmes et al.
5,721,179 A 2/1998 Shi et al.
5,738,940 A 4/1998 Neuert
5,795,835 A 8/1998 Bruner et al.
5,845,476 A 12/1998 Kolmes
5,848,524 A * 12/1998 Lappage ..... D01H 1/02 57/315
5,851,668 A 12/1998 Sandor et al.
5,976,998 A 11/1999 Sandor et al.
6,033,779 A 3/2000 Andrews
6,076,344 A * 6/2000 Doujak ..... D07B 3/00 57/9
6,103,372 A 8/2000 Sandor et al.
6,109,066 A 8/2000 Loubinoux et al.
6,126,879 A 10/2000 Sandor et al.
6,127,028 A 10/2000 Sandor et al.
6,146,759 A 11/2000 Land
6,155,084 A 12/2000 Andrews et al.
6,159,599 A 12/2000 Sandor et al.
6,162,538 A 12/2000 LaNieve et al.
6,182,434 B1 2/2001 Kubový et al.
6,210,798 B1 4/2001 Sandor
6,287,690 B1 9/2001 Land
6,363,703 B1 4/2002 Kolmes
6,405,519 B1 * 6/2002 Shaikh ..... D01H 1/115 57/12
6,410,140 B1 6/2002 Land et al.
6,413,636 B1 7/2002 Andrews et al.
6,425,237 B1 * 7/2002 Greifeneder ..... D02G 3/38 57/210
6,467,251 B1 10/2002 Kolmes
6,532,724 B2 3/2003 Patrick
6,553,749 B2 4/2003 Land et al.
6,562,741 B1 5/2003 Lilani
RE38,136 E 6/2003 Kolmes
6,581,366 B1 6/2003 Andrews
6,606,846 B2 8/2003 Land
6,701,703 B2 3/2004 Patrick
6,706,650 B2 3/2004 Gibson et al.
6,796,115 B1 * 9/2004 Patrick ..... D02G 3/22 28/107
6,952,915 B2 * 10/2005 Prickett ..... D02G 3/047 57/211
7,065,949 B2 6/2006 Guevel et al.
7,155,891 B2 1/2007 Bader
7,310,932 B2 * 12/2007 Liao ..... D01F 8/14 57/210
7,380,579 B2 * 6/2008 Esnault ..... D02G 3/48 152/451
7,465,418 B2 12/2008 Boissonnat et al.
7,469,526 B2 * 12/2008 Patrick ..... D02G 3/185 57/229
7,493,747 B2 2/2009 Bader
7,601,414 B2 10/2009 Handermann et al.
7,638,193 B1 12/2009 Rebouillat et al.
7,669,442 B1 3/2010 Zhu
7,749,601 B2 7/2010 Zhu et al.
7,841,162 B2 * 11/2010 Coombs ..... D02G 3/38 57/210
7,913,483 B2 * 3/2011 Qiu ..... D01H 1/006 57/5
7,934,394 B2 5/2011 Zhu
7,934,395 B2 5/2011 Zhu
7,934,396 B2 5/2011 Zhu
7,934,397 B2 5/2011 Zhu
7,958,812 B2 6/2011 Wang et al.
8,074,436 B2 * 12/2011 Hardee ..... D02G 3/442 57/224
8,093,160 B2 * 1/2012 Tharpe, Jr. ..... D02G 3/328 442/191
8,137,094 B2 3/2012 Boissonnat et al.
8,171,712 B2 * 5/2012 Hsu ..... D02G 3/367 57/224
8,209,785 B2 7/2012 Underwood et al.
8,215,092 B2 * 7/2012 Tharpe, Jr. ..... D03D 15/513 57/224
8,528,120 B2 9/2013 Underwood et al.
8,732,863 B2 5/2014 Hines et al.
8,793,814 B1 8/2014 Dilanni et al.
8,926,933 B2 1/2015 Zhang et al.
9,091,000 B2 7/2015 Mizohuchi et al.
9,279,198 B2 * 3/2016 Carrara ..... D02G 3/385
9,364,694 B2 6/2016 Underwood et al.
9,745,674 B2 8/2017 Hines et al.
9,765,454 B2 9/2017 Tutterow et al.
9,890,476 B2 2/2018 Kübler et al.
9,938,645 B2 4/2018 Stanhope et al.
10,030,326 B2 7/2018 Hines, Jr. et al.
10,161,066 B2 * 12/2018 Yeung ..... D01H 1/025
10,253,435 B2 4/2019 Zhu
10,253,437 B2 4/2019 Zhu
10,344,406 B2 7/2019 Wirth et al.
10,704,168 B2 * 7/2020 Yenici ..... D04B 21/18
2002/0011062 A1 1/2002 Patrick
2002/0124544 A1 9/2002 Land et al.
2003/0074879 A1 4/2003 Patrick
2003/0159422 A1 8/2003 Guevel et al.
2004/0077241 A1 4/2004 Campbell et al.
2004/0091705 A1 5/2004 Hanyon et al.
2005/0055997 A1 * 3/2005 Bader ..... D02G 3/367 57/224
2005/0086924 A1 4/2005 Kolmes
2005/0091961 A1 5/2005 Prickett
2005/0155336 A1 7/2005 Robins
2006/0110597 A1 5/2006 Koralek
2006/0264136 A1 11/2006 Chiantese
2006/0292953 A1 12/2006 Ashley et al.
2007/0062172 A1 3/2007 Bader
2007/0062173 A1 3/2007 Hummel
2007/0117486 A1 5/2007 Serillon
2007/0214843 A1 9/2007 Scott
2008/0057807 A1 3/2008 Tutterow et al.
2010/0112312 A1 5/2010 Tutterow et al.
2011/0104466 A1 5/2011 Atkinson
2013/0042385 A1 2/2013 Hines et al.
2013/0065470 A1 3/2013 Rock et al.
2013/0212790 A1 8/2013 Waxman et al.
2014/0090349 A1 * 4/2014 Fisher ..... D02G 3/12 57/222
2015/0086758 A1 3/2015 Tutterow et al.
2016/0053411 A1 2/2016 Atkinson
2016/0237594 A1 8/2016 Rock et al.
2017/0058435 A1 3/2017 Couture et al.
2017/0354907 A1 12/2017 Ray et al.
2018/0002840 A1 1/2018 Tutterow et al.
2018/0057972 A1 * 3/2018 Morrell ..... D02G 3/328
2018/0057978 A1 3/2018 Zhu
2018/0127899 A1 5/2018 Tutterow et al.
2018/0135211 A1 5/2018 Terada et al.
2018/0347079 A1 12/2018 Shimada et al.
2018/0371648 A1 12/2018 Atkinson
2019/0055676 A1 2/2019 Chen
2019/0085486 A1 * 3/2019 Huang ..... D02G 1/028

(56) References Cited

U.S. PATENT DOCUMENTS

| | | | | |
|---|---|---|---|---|
| 2019/0166932 | A1 | 6/2019 | Taylor et al. | |
| 2020/0131675 | A1* | 4/2020 | Bhatnagar | D02G 3/04 |
| 2020/0347527 | A1* | 11/2020 | Konukoglu | D02G 3/32 |
| 2021/0189607 | A1 | 6/2021 | Patrick et al. | |
| 2021/0348310 | A1 | 11/2021 | Bivens et al. | |
| 2022/0106712 | A1* | 4/2022 | Wynne | D02G 3/36 |

FOREIGN PATENT DOCUMENTS

| | | | | |
|---|---|---|---|---|
| EP | 22895 | A1 | 1/1981 | |
| EP | 375113 | A2 | 6/1990 | |
| EP | 520023 | B1 | 5/1995 | |
| EP | 498216 | B1 | 11/1995 | |
| EP | 533931 | B1 | 1/1998 | |
| EP | 845551 | B1 | 2/2004 | |
| EP | 1160363 | B1 | 4/2005 | |
| EP | 1336674 | B1 | 1/2007 | |
| EP | 1649089 | B1 | 2/2007 | |
| EP | 1678356 | B1 | 1/2008 | |
| EP | 1218578 | B1 | 3/2010 | |
| EP | 2184388 | A1 | 5/2010 | |
| EP | 2206811 | A2 | 7/2010 | |
| EP | 2074248 | B1 | 3/2011 | |
| EP | EP2097566 | B1 | 9/2011 | |
| EP | 1780318 | B1 | 11/2012 | |
| EP | 2184388 | B1 | 10/2013 | |
| EP | 2644759 | A1 | 10/2013 | |
| EP | 2650415 | A1 | 10/2013 | |
| EP | 1628824 | B1 | 2/2014 | |
| EP | 2695978 | A1 | 2/2014 | |
| EP | 2758572 | B1 | 3/2015 | |
| EP | 2762618 | B1 | 8/2016 | |
| EP | 2644759 | B1 | 4/2017 | |
| EP | 2347042 | B1 | 8/2017 | |
| EP | 3231906 | A1 | 10/2017 | |
| EP | 3385416 | A1 | 10/2018 | |
| EP | 3385418 | A4 | 1/2019 | |
| EP | 3483315 | A1 | 5/2019 | |
| EP | 3231905 | B1 | 6/2019 | |
| JP | 05044130 | A * | 2/1993 | |
| JP | 2000-303271 | A | 10/2000 | |
| JP | 2000-328384 | A | 11/2000 | |
| JP | 2017125278 | A | 7/2017 | |
| KR | 10-0723432 | B1 | 5/2007 | |
| SU | 1015008 | A1 | 4/1983 | |
| WO | WO1990/003462 | A1 | 4/1990 | |
| WO | WO1995/031593 | A1 | 11/1995 | |
| WO | WO1997/018345 | A1 | 5/1997 | |
| WO | WO1997/025464 | A1 | 7/1997 | |
| WO | WO1999/035315 | A1 | 7/1999 | |
| WO | WO2001/023652 | A1 | 4/2000 | |
| WO | WO2001/098568 | A2 | 12/2001 | |
| WO | WO-03012183 | A1 * | 2/2003 | D02G 3/46 |
| WO | WO2003/018890 | A1 | 3/2003 | |
| WO | WO2003/104538 | A1 | 12/2003 | |
| WO | WO2004/076730 | A3 | 11/2004 | |
| WO | WO2004/106606 | A2 | 12/2004 | |
| WO | WO2005/019512 | A2 | 3/2005 | |
| WO | WO2005/045109 | A1 | 5/2005 | |
| WO | WO2007-117052 | A1 | 10/2007 | |
| WO | WO2007/140905 | A1 | 12/2007 | |
| WO | WO2008/045459 | A1 | 4/2008 | |
| WO | WO2010/006222 | A1 | 1/2010 | |
| WO | WO2011/018685 | A2 | 2/2011 | |
| WO | WO2011/100202 | A2 | 8/2011 | |
| WO | WO/2012/006560 | A2 | 1/2012 | |
| WO | WO2012/100305 | A1 | 8/2012 | |
| WO | WO2013/078287 | A1 | 5/2013 | |
| WO | WO2013/151753 | A1 | 10/2013 | |
| WO | WO2014/066754 | A2 | 5/2014 | |
| WO | WO2015/066688 | A2 | 5/2015 | |
| WO | WO2016/010659 | A1 | 1/2016 | |
| WO | WO2016/033593 | A1 | 3/2016 | |
| WO | WO2016/083616 | A1 | 6/2016 | |
| WO | WO2016/135211 | A2 | 9/2016 | |
| WO | WO2017/080594 | A1 | 5/2017 | |
| WO | WO2017/219926 | A1 | 12/2017 | |
| WO | WO2018/085331 | A1 | 5/2018 | |
| WO | WO2018/185049 | A1 | 10/2018 | |
| WO | WO2019/016414 | A1 | 1/2019 | |
| WO | WO2019/118643 | A1 | 6/2019 | |
| WO | WO2019/134090 | A1 | 7/2019 | |

OTHER PUBLICATIONS espacenet.com; Machine Translation; Toray Industries Inc.; JP-2017125278-A; 2017.

International Search Report and the Written Opinion of the International Searching Authority for PCT/US2020/065673, dated Apr. 15, 2021.

* cited by examiner

METHODS AND SYSTEMS FOR FORMING A COMPOSITE YARN

TECHNICAL FIELD

The present invention relates to fabrics, yarns and processes for making composite yarns. In particular, the present invention relates to composite spun yarns having a core surrounded by a fiber bundle embedded with one or more filaments, and a process of forming such composite spun yarns displaying desirable performance characteristics, such as enhanced strength and cut-resistance.

BACKGROUND

High performance yarns and fabrics with enhanced physical properties, such as cut-resistance, increased strength, and thermal/fire-resistance properties, may be formed by combining various fibers and filaments that incorporate such properties. For example, such high performance yarns generally include cores, formed from one or more filaments or fibers such as glass, metals, or synthetic or polymeric materials such as aramid or para-aramids. The cores are often wrapped with one or more additional filaments or fibers, generally including various natural and synthetic or polymeric materials. Unfortunately, a common draw-back of many conventional high performance yarns is a failure to exhibit an optimum combination of economy and performance, i.e. such yarns can often require greater expense in the manufacture thereof due to the nature of the materials used in conventional high performance yarns and the performance characteristics expected therefrom. In addition, there is need to try to minimize direct skin contact between a wearer of a garment made from such composite yarns and potentially abrasive core filaments (i.e. aramid, para-aramid, glass or steel fibers/filaments) of the composite yarns. Consequently, there is a continuing need for alternative high performance yarns and fabrics that addresses the foregoing and other related and unrelated problems in the art.

SUMMARY

Briefly described, the present disclosure is, in one aspect, directed to methods and systems for forming composite spun yarns with desired performance characteristics. In an embodiment, a method for making a composite yarn may be provided. The method of forming a composite yarn includes spinning at least one core filament (i.e. a glass, a metal, or a synthetic/polymeric filament having cut-resistant and/or heat resistance properties) with one or more rovings of staple fibers, which can be of the same or a similar type so as to form a substantially blended fiber bundle that will be spun about the core filament. For example, the fibers of the fiber bundle can be natural or synthetic/polymeric fibers such as cotton, nylon, etc. . . . having additional selected properties such as moisture wicking, softness, etc. . . . to be incorporated with the properties of the core filament. As the core filament and fibers from the roving(s) are spun together, an additional or first filament further is introduced to the spinning frame.

The additional or first filament is applied at approximately the same turns per inch as the roving fibers are spun or twisted about the core filament so as to be integrated with the fiber bundle. The integrated additional filament/fiber bundle mass is spun/twisted around the core filament, which is substantially centered and enclosed within the integrated filament/fiber bundle, forming an initial or base yarn that is spun in a first direction so as to have an initial "S" or "Z" direction of twist. During this operation, the core filament is covered by and encased within the integrated filament/fiber bundle that forms a sheath or wrapping around the core filament to an extent that the core filament substantially is bound and locked within the integrated filament/fibrous bundle or sheath. As a result of this twisting/wrapping of integrated filament/fibrous bundle locking the core filament there-within, the core filament is protected from being exposed or pulled out of the resultant composite yarn during subsequent knitting, weaving or other operations to form a fabric therefrom.

The method can further include plying the base yarn with a further or second filament or yarn component/bundle, which can be applied at an angle of about 10°-45°, during an additional spinning or twisting operation. Such additional filament or yarn generally will be selected based on additional technical properties or characteristics, in addition to the cut resistance and other properties of the base yarn, that are desired to be incorporated within the resultant composite high performance yarn and fabrics woven, knitted or otherwise formed therefrom. During this additional spinning/twisting operation, the base yarn and the second or further filament or yarn plied therewith are spun in an opposite direction to apply an opposing twist (e.g. an opposite Z or S twist) and to an extent (e.g. at a number of twists per inch or rate/amount of twist) selected/designed to substantially minimize the torque of the finished composite yarn.

In addition, or alternatively, the second filament or yarn component could be added to the initial spinning operation, i.e. with the first filament, such that the second filament also can be intermingled with both the first filament and the fibers of the roving(s) as they are wrapped and twisted about the core filament in the first direction. As a result, the first and second filaments can be substantially integrated within the fiber bundle defining the wrapping or covering enclosing the core filament and with the additional filament twisted thereabout to form a base yarn having an initial "S" or "Z" direction of twist with its core filament substantially locked and bound within a sheath or covering fibers/filaments. Thereafter, the method further can include plying one or more additional filaments (e.g. a third filament) with the base yarn at an angle, and spinning the base yarn and third filament together in a second direction opposite the first direction sufficient to substantially minimize the torque of the finished composite yarn while providing further selected or desired performance characteristics/properties to the yarn.

In another embodiment, a composite high performance yarn having enhanced cut resistance and/or other selected technical or performance properties is disclosed. The composite yarn generally will include a first yarn component that can include a blended fiber bundle applied as a wrapping or covering spun about a central core that may be formed by one or more substantially continuous filaments or fibers selected from materials having a selected or pre-determined high hardness of, for example, approximately 7.0 or greater on the Mohs hardness scale. The fiber bundle can include fibers of natural and/or synthetic materials (for example, cotton, wool, nylon, etc. . . . ), generally selected to provide protection from contact between the core filament(s) and a person's skin, as well as providing other desired characteristics such as softness, moisture wicking, and/or other properties. The high hardness core filament typically can be formed from metals such as tungsten or alloys thereof, or other, similar high hardness metal or synthetic materials, for forming a first or base yarn component with a hardness of at least approximately 7.0 or greater on the Mohs hardness scale.

A high hardness core first yarn component thus will be formed with enhanced cut resistance and with additional selected or desired properties based on the fibers spun or wrapped thereabout and forming the sheath or covering. In addition, as the high hardness core filament is spun and wrapped with the sheath of fibers, e.g. staple or natural such as cotton, wool, etc., or synthetic fibers including aramids, para-aramids, nylon, etc., one or more additional filament(s) or yarn(s) can be added during the spinning process so as to be integrated and twisted with the high hardness core first yarn component. In various embodiments, the additional filament(s) or yarn(s) generally can include materials such as polyester, nylons, lycra, para-aramids, high density polyethylene, low linear polyethylene, high density polypropylene, PTT, and combinations or blends thereof, which can be selected to help bind or lock the high hardness core within the fibrous bundle, while also providing additional performance characteristics and/or protection to the high hardness core.

The additional filament(s) also will be spun/twisted with and is integrated into the fibrous bundle, which integrated filament/fibrous bundle is wrapped and/or twisted about the core filament, defining a close wrapped sheath or covering with an additional, integrated wound filament twisted about the core filament. The wrapping fibers, the core filament(s), and the first filament (and any additional independent filament in some embodiments) further will be spun together to form an initial or base yarn that generally will have a twist oriented in a first direction (e.g. an "S" or "Z" direction), and with the integrated filament/fiber bundle being twisted and/or spun about the core filament at a number of turns per inch sufficient to substantially bind the filament and fibers of the bundle together and lock about the core filament(s) within the integrated filament/fiber bundle. As a result, the first yarn component core filament is formed with its substantially encapsulated within the integrated filament/fiber bundle sufficient to bind and protect the core from becoming pulled or otherwise exposed during later finishing, knitting, weaving or other operations to which the composite yarn is subjected to form high performance or technical fabrics.

The composite yarn further can include one or more further (e.g. second or third) filament(s) or a second yarn component that will be plied with the base or first yarn component and spun therewith in a subsequent spinning operation. For example, the high hardness core spun first yarn component can be plied and spun with a second yarn component comprising a glass core yarn having a core of a glass or fiberglass material encapsulated within a sheath of fibers. The plied second yarn component generally will be selected to provide additional desired properties or performance characteristics, e.g., additional cut or abrasion resistance from the glass core, and other properties such as softness, moisture wicking, etc., that can be provided by the sheath fibers.

The second yarn component further generally will be wrapped or twisted about the first or base yarn component, for example, being applied and/or twisted at an angle of about 10°-45° (though other angles also can be used). During such spinning, the first or base and the second yarn components further generally will be spun or twisted in a second direction that is opposite the first direction to create/apply an opposite direction twist sufficient to substantially minimize the torque created in the base yarn during the initial spinning operation. The resultant composite high performance yarn can thus have a substantially reduced or minimized level of torque while also incorporating the performance characteristics or properties of the second yarn component with the high hardness and cut resistance and other properties of the first yarn component.

In one aspect, a method of making the composite yarn can include spinning at least one core filament with a series of staple fibers, and introducing a first filament during spinning of the series of staple fibers about the at least one core filament. The series of staple fibers and the first filament will be combined to form a fibrous bundle, the fibrous bundle wrapped about the at least one core filament to form a base yarn that is spun in a first twist direction. The first filament is also generally applied at approximately the same turns per inch as the series of staple fibers. The method also includes plying at least one additional filament or an additional yarn bundle to the base yarn to form a base yarn bundle, and twisting the at least one additional filament in a second twist direction opposite the first twist direction.

The composite yarn can comprise a base yarn having a core filament having a fibrous bundle spun or twisted thereabout, wherein the fibrous bundle includes a first filament introduced during spinning of a series of sheath fibers about the core filament such that the first filament and the sheath fibers form an integrated filament and fibrous bundle that is twisted about the core filament sufficient to substantially lock and bind the core filament within the integrated filament and fibrous bundle and with the first filament being twisted with the sheath fibers about the core filament at approximately the same turns per inch as the sheath fibers to produce the base yarn with a first twist direction. At least one additional filament or an additional or second yarn is piled and spun with the base yarn, wherein the at least one additional filament or yarn is spun with the base yarn in a second twist direction opposite the first twist direction sufficient to substantially minimize torque in the composite yarn.

In another aspect, a method of making the composite yarn can comprise spinning a first core filament with a series of fibers and at least one additional filament introduced during spinning so as to form an integrated filament/fiber sheath about the first core filament to form a first yarn component, wherein the first core filament comprises a material having a hardness of at least approximately 7.0 or greater on the Mohs hardness scale and is substantially bound and locked within the filament/fiber sheath. The method also includes plying the first yarn component with a second yarn component having at least one second core filament including a glass component and spinning the first yarn component with the second yarn component to form a composite yarn with the first yarn component forming a core of the composite yarn having a hardness of at least approximately 7.0 or greater on the Mohs hardness scale and wrapped with the second yarn component.

In another aspect, the composite yarn can comprise a first yarn component a formed of a material having a hardness of at least approximately 7.0 on the Mohs hardness scale, a first sheath of fibers spun about the at least one first core filament and an additional filament introduced during spinning of the first sheath of fibers about the core so as to be twisted about the core sufficient to substantially lock the core within the first sheath of fibers. A second yarn component comprising a glass core and a second sheath of fibers can be applied about the glass core wherein the first yarn component is ring spun with the second yarn component to form the composite yarn having the first yarn component as the core of the composite yarn with the second yarn component twisted thereabout.

Various objects, features and advantages of the present invention will become apparent to those skilled in the art upon a review of the following detail description, when taken in conjunction with the accompanying drawings.

BRIEF DESCRIPTION OF THE FIGURES

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which:

FIGS. 4A-4B are side views of an embodiment of the composite yarn having a high hardness core according to the principles of the present disclosure;

FIG. 5 illustrates a flowchart of an embodiment of a method for making a composite yarn, according to the principles of the present disclosure.

The use of the same reference symbols in different drawings indicates similar or identical items.

DETAILED DESCRIPTION

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

In general, the present invention is directed to systems and methods for formation of high performance composite spun yarns. These composite yarns generally exhibit properties such as enhanced cut-resistance and strength. Some of the embodiments of the present disclosure contain processes that help impart useful performance properties to the finished composite yarns. These performance properties may then be imparted to fabrics made of such composite yarns and the garments formed therefrom. In general, the yarns of the present invention are designed to be produced using a ring or other type of spinning frame and spinning process.

The finished composite yarns formed by these processes further generally are designed to endure the mechanical and physical abuses of knitting or weaving machinery without sustaining physical damage causing the core filament to protrude or otherwise become exposed (i.e. with the potential for their core filaments being pulled out or bubbling through the sheath or covering being substantially minimized) during knitting or weaving of the yarns into fabrics, as well as during other operations such as needle punching, tufting, etc. . . . for forming various woven and/or non-woven performance fabrics. The resultant high performance fabrics formed from the composite yarns typically have enhanced performance properties, such as increased strength, abrasion or cut-resistance, and/or fire/heat resistance. Such fabrics can be used in forming protective garments such as protective gloves, outer wear such as firefighters' coats, or a variety of other type of garments and articles for which properties such as a high cut resistance, impact resistance, enhanced strength, enhanced fire or heat resistance, are necessary or desired, but also have further desired properties such as softness or feel to enable enhanced mobility and/or flexibility of the fabrics with the wearer being protected from contact with potentially abrasive cut or fire/heat resistant materials within the yarns. The high performance composite yarns of the present disclosure also can be used in industrial webbing, belting and other applications.

Figure 1A:
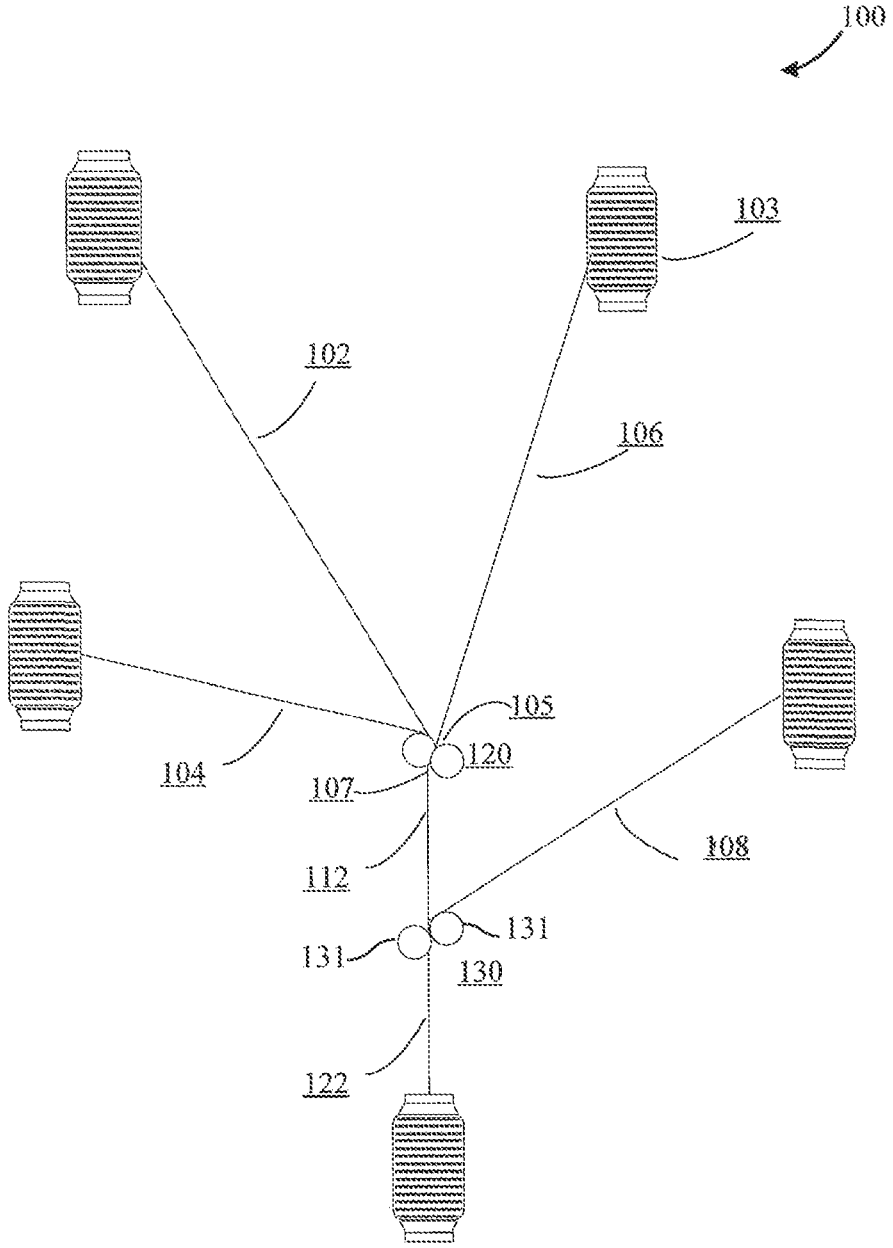
FIGS. 1A-1B are schematic illustrations of systems and methods for making a composite yarn, according to an embodiment of the disclosure.
Figure 1B:
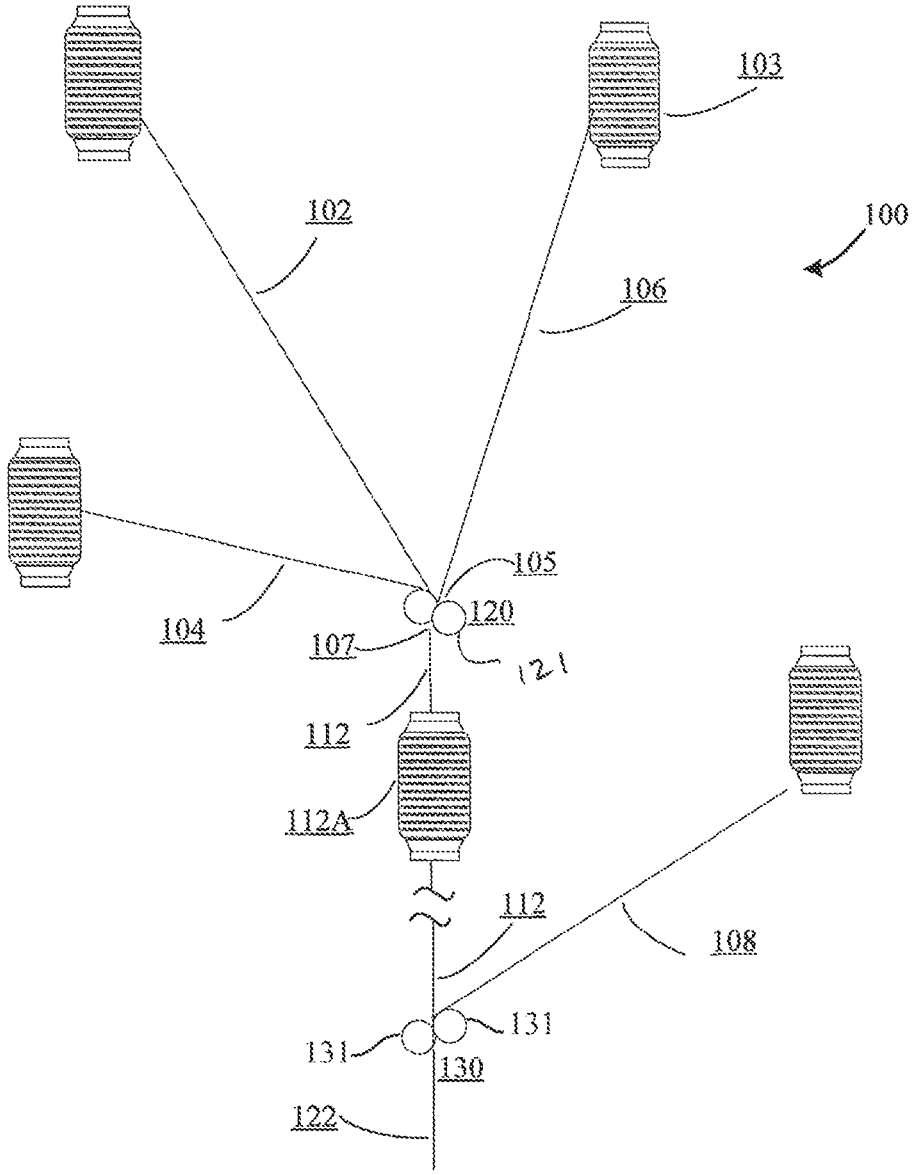

FIGS. 1A-1B illustrate a system and processes for making a composite yarn, in accordance with embodiments of the disclosure. As indicated, at least one core filament 102 will be introduced to the front delivery rolls 121 of an initial spinning operation 120. The initial spinning operation 120 may include a spinning frame which forms a part of a ring spinning process. The at least one core filament 102 can be composed of one or more materials selected for, for example, thermal or cut-resistance, and may be composed of a glass, a metal, a synthetic/polymer or a natural material having cut-resistant and/or heat resistant properties.

In an embodiment, the at least one core filament 102 may include any suitable inorganic or organic glass or fiberglass material. In addition or alternatively, the at least one core filament 102 may be formed from any suitable metal, such as, for example, steel, stainless steel, aluminum, tungsten, copper, bronze, alloys thereof and the like as well as, synthetic or natural filaments materials selected from acrylics, modacrylics, polyesters, high density polyethylenes (including ultra-high molecular weight polyethylene fibers such as SPECTRA® fibers available from Honeywell International Inc. of Charlotte, N.C., Dyneema® fibers available from Royal DSM of Heerlen, Netherlands, and Tsunooga® fibers available from Toyobo Co., Ltd., of Osaka, Japan), polyamides, linear low density polyethylenes, polyethylenes, liquid crystal polyesters, liquid crystal polymers such as Vectran™ (e.g., a high-strength polyarylate fiber available from Kuraray Co., Ltd, of Osaka, Japan), silica, para-aramids, polypropylenes, nylons, cellulosics, PBI (polybenzimidazole), graphites, and other carbon-based fibers, copolymers and blends thereof.

In some embodiments, glass filaments can be used for or as a part of the at least one core filament 102 and can vary in thickness from, for example, between about 50 denier to about 1200 denier and can be twisted or untwisted. In other embodiments, various metal (e.g. steel, aluminum, etc. . . . ), natural and/or synthetic filaments used for as or part of the at least one core filament 102 likewise generally can vary in thickness from between, for example, about 25 microns to about 400 microns, twisted or untwisted. Greater or lesser filament sizes or thicknesses also can be used for the glass, metal, natural and synthetic filaments as desired or needed, depending upon the application for the composite yarn 122.

Referring again to FIGS. 1A-1B, the at least one core filament 102 is spun in the initial spinning operation 120 with a series of fibers 106 that can be supplied from one or more rovings 103. The fibers can be fed as fine strands of condensed slivers, and may be formed from materials similar to those of the of the at least one core filament 102. The fibers 106 further generally will be selected to provide a substantially complete coverage of the at least one core filament as well as additional selected properties, such as softness/feel, static dissipation, cut resistance, abrasion resistance, and/or insulative properties, etc. The materials forming the fibers 106 may include aramids, para-aramids, meta-aramids, modacrylics, opan, high density polyethylene, nylons, polyesters, linear low density polyethylenes, polypropylenes, cellulosics, rayon, silica, wool, cotton, acrylic, carbon fibers, polyamides, metals, liquid crystal polymers, low linear polyethylenes, PTT, PBI, and blends thereof. The staple fibers 106 fed from the roving(s) will be combined and spun with or twisted about the at least one core filament 102 so as to form a wrapping/covering blend or fiber bundle 105 that will substantially encapsulate and enclose the at least one core filament 102 therein.

As the at least one core filament 102 and the staple fibers 106 from the roving are spun together, an additional or first filament 104 further is introduced into the initial spinning operation 120. In an embodiment, the first filament 104 can comprise a material substantially similar to a material of the at least one core filament 102. In other embodiments, the first filament 104 can comprise a material substantially different to the material of the at least one core filament 102. For example, suitable materials for the first filament 104 can include polyester, nylon, PTT (polytrimethylene terephthalate), lycra, para-aramids, high density polyethylene, and blends thereof.

The first filament 104 is introduced to the initial spinning operation 120 with the fibers 106, generally being fed into the area where the fibers 106 are spun about the at least one core filament such that the first filament 104 is combined and/or intermingled with the fibers 106 of the fiber bundle 105 being spun or twisted about the core filament to form an integrated fibrous bundle 107. In an embodiment, the first filament 104 can be introduced to the fiber bundle 105, for example, from the side as indicated in the Figures, before or as the fiber bundle is being formed or as it exits the initial spinning operation 120.

Introducing the first filament 104 in this manner causes the first filament 104 to integrate with the fibers 106 to form the integrated fibrous bundle 107 that surrounds the at least one core filament 102, with the first filament 104 and fibers 106 twisted thereabout to an extent to lock the at least one core filament substantially within a middle or center of the integrated fibrous bundle. The first filament becomes embedded as an integral component in the resulting base yarn 112, and further generally is applied at approximately the same turns per inch as that of the fibers 106 so that the filament/fibrous bundle 107 substantially encapsulates and binds the core filament 102 within the center of the yarn, rather than being loosely covered or wrapped as provided by a typical covering process, wherein binding/locking of the core filament within its protective fibrous bundle helps minimize the core filament from being exposed/pulled out when the composite yarn 122 is subjected to mechanical stress during knitting, weaving, etc. to form fabric.

The integrated filament/fibrous bundle thus is wrapped around and binding the at least one core filament 102 forms a base yarn 112 that is spun with a twist in a first direction. In an embodiment, the first direction of twist can be a S-direction or counter-clockwise direction of twist. In another embodiment, the first direction of twist is a Z-direction or clock-wise direction of twist. The twisting or spinning of integrated filament/fibrous bundle about the core filament is done to an extent sufficient to lock the at least one filament 102 within the wrapping/sheath defined by the integrated filament/fibrous bundle, so as to ensure that the at least one core filament 102 is protected from abrasion or cutting; and also protects and or retards against the at least one core filament from projecting or protruding from the integrated fibrous bundle forming a wrapping or covering sheath thereabout (i.e. containing the core filament within the composite yarn even if it becomes broken or splintered such as when exposed to mechanical stresses during knitting, weaving or other operations) to protect a wearer from inadvertent engagement therewith.

Referring again to FIGS. 1A-1B, the base yarn 112 formed by the initial spinning operation 120 thereafter may be plied with an additional yarn bundle or at least one additional filament 108 that will be twisted or spun thereabout during an additional spinning/twisting operation 130 to form a composite yarn bundle 122. The at least one additional filament or yarn 108 generally will be introduced at an angle of between about 10° and about 45° (although other angles also can be used), and will be selected to provide additional desired/selected performance characteristics or properties such as softness/feel, abrasion resistance, moisture wicking, etc. . . . . The additional filament or yarn 108 also will be spun in a second twist direction opposite to the first twist direction (e.g. an opposite Z or S twist), and the additional filament or yarn 108 also will be twisted or spun about the base yarn at a number of turns or twists per inch selected or designed to substantially neutralize and/or minimize the resultant torque of the finished composite yarn 122.

As indicated in FIG. 1A, in one embodiment, the additional filament or yarn can be introduced as part of a substantially continuous operation, for example being fed to drafting rollers 131 of a second spinning system or operation 130 to thus form the composite yarn 122.

Alternatively, as indicated in FIG. 1B, the addition of the further or second filament or yarn 108 can be carried out in a subsequent or separate spinning process 130. For example, the base yarn 112 can be formed and collected on a roving 112A or spindle, and thereafter can be transferred to a separate or downstream spinning frame 130 for spinning or twisting the additional filament or yarn 108 thereabout.

In an embodiment, a mass ratio of the at least one core filament 102 in the resultant composite yarn 122 formed from the base yarn bundle 112 can be between about 10% and about 60%. In another embodiment, a mass ratio of the at least one additional filament 104 in the resultant composite yarn 122 formed from the base yarn bundle 112 can be between about 3% and about 35%. These mass ratio ranges are example ranges, and different mass ratio ranges may be considered to meet certain desired characteristics of the resultant composite yarn.

Figure 2:
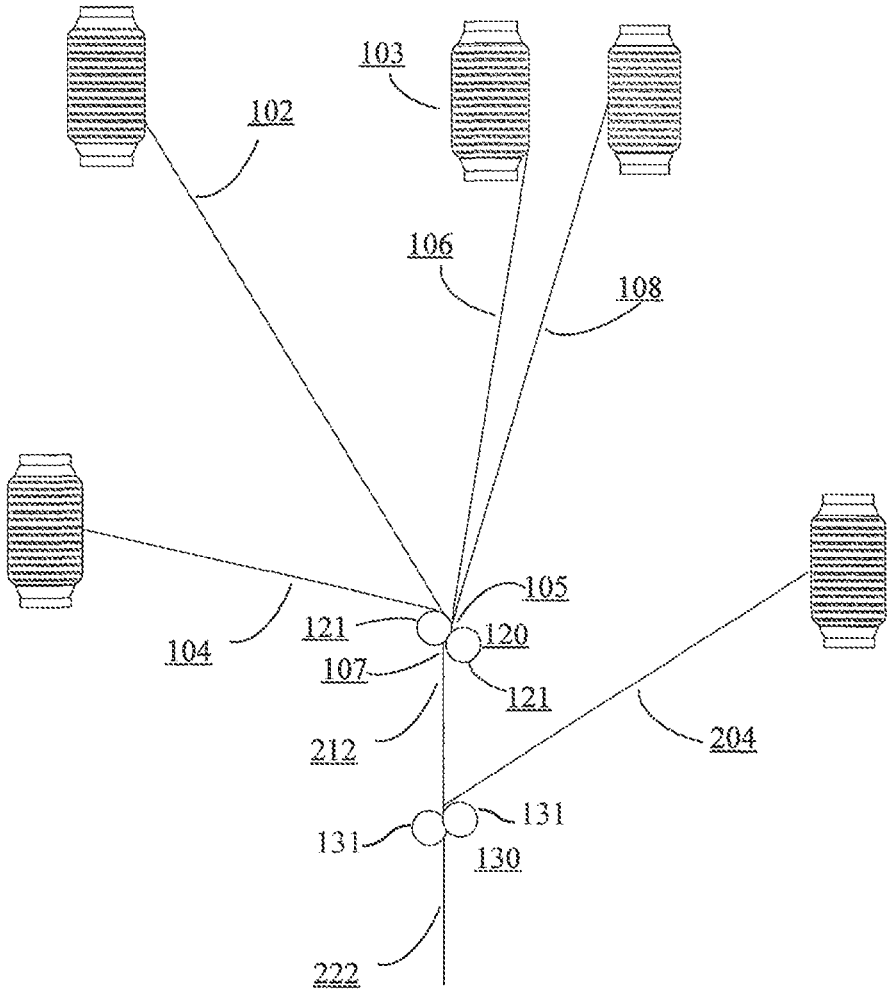
FIG. 2 illustrates another example system and method for making a composite yarn, according to an embodiment of the disclosure.

In an additional embodiment illustrated in FIG. 2, the second filament or the at least one additional filament or yarn 108 can be added to the initial spinning operation 120, i.e. during the process in which the first filament 104, is spun or twisted about the core filament 102 and integrated with the fibers 106 and a further yarn or filament 204 can also be plied and spun with the resultant base yarn 212. In such an embodiment, the second filament 108 also will be intermingled/integrated with both the first filament 104 and the fibers 106 of roving(s) 103 as the first filament 104 and the fibers 106 are wrapped about the core filament 102 in the first direction. As a result, the first filament 104 and the second filament 108 will be substantially integrated within the staple fiber bundle defining a binding covering about the core filament 102 to form a base yarn 212 having an initial "S" or "Z" direction of twist, and a central core filament that is substantially locked and encapsulated within the integrated filaments and fiber bundle so as to protect the core filament 102 from being pulled or bubbling out or otherwise becoming exposed during subsequent use/operations such as knitting or weaving of the composite yarn into a fabric, as can potentially occur with loose wrappings or coverings as with more traditional spun yarns.

Thereafter, one or more additional filaments (e.g. a third filament 204) may be plied with the base yarn 112, for example being introduced at an angle of between about 10° and about 45°, and spun together with the base yarn 112 in a second direction opposite the first direction with/at a number of twists per inch sufficient to provide additional properties or performance characteristics to substantially neutralize and/or minimize the torque of the finished composite yarn 222. In embodiments, the materials forming the one or more additional filaments (e.g., the second filament 108 and/or the third filament 204) may include, for example, polyester, nylon, lycra, para-aramids, high density polyethylene, a high-strength polyarylate fiber such as Vectran™ available from Kuraray Co., Ltd, of Osaka, Japan, PTT, PBI, polypropylene, rayon, wool, carbon fibers, polyamides, stainless steel, cotton, modacrylic, and combinations thereof.

Figure 3:
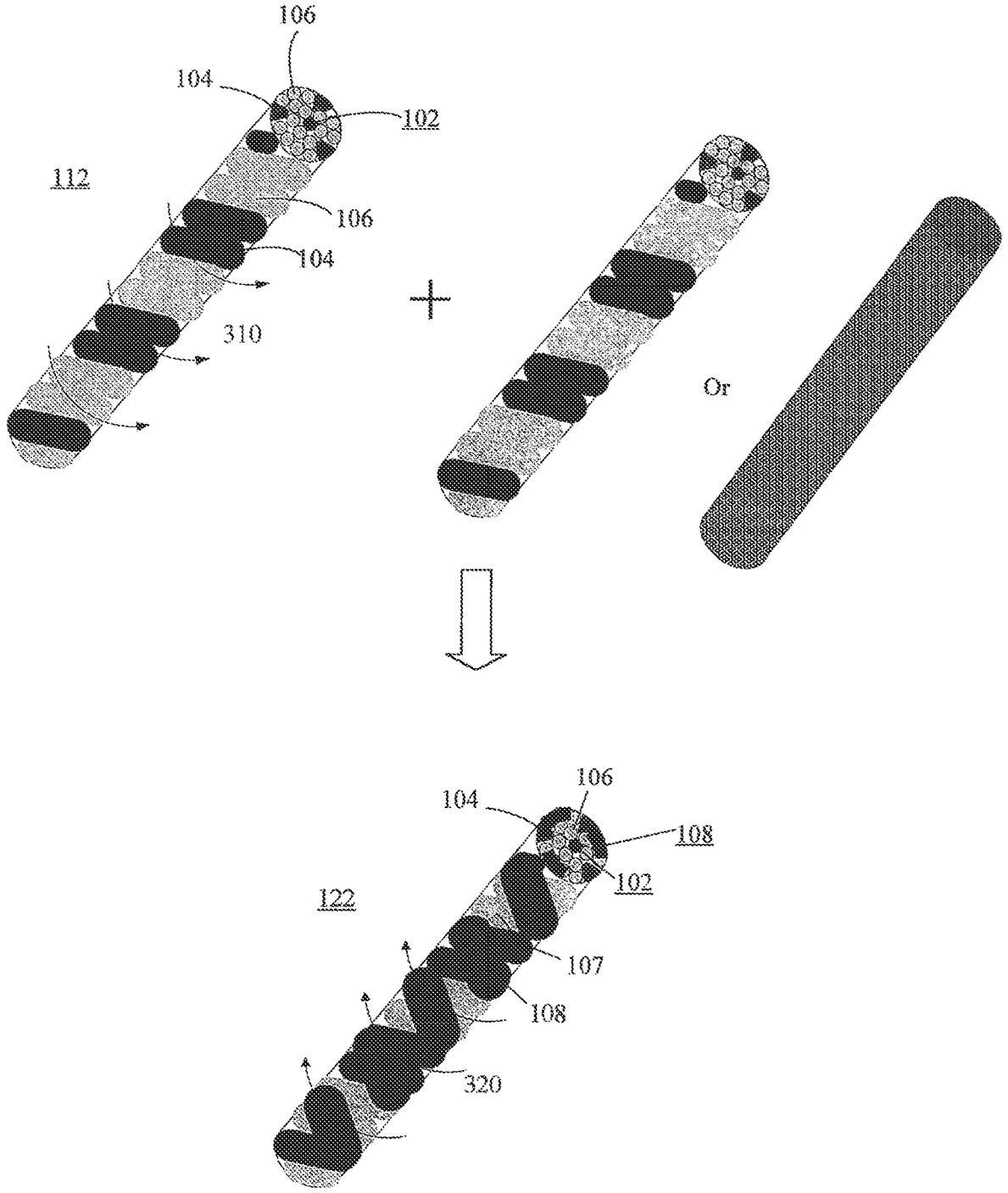
FIG. 3 shows a perspective view of a base yarn and a base yarn bundle for making a composite yarn, according to an embodiment of the disclosure.

In embodiments, the composite high performance yarn (shown at 122 in FIG. 3), for example, having enhanced cut resistance and/or fire or heat resistance includes a staple fiber bundle 106 applied as a wrapping or covering spun about a core filament 102 that may be formed by one or more substantially continuous filaments 102 selected from materials such as glass, metals or synthetic/polymeric materials having a high level of cut and/or fire or heat resistance. The fibers of the fiber bundle 106 can include staple fibers of natural and/or synthetic materials (for example, cotton, wool, nylon, etc. . . . ) that can be selected to provide protection from contact between the core filament(s) and a person's skin, as well as providing other desired characteristics such as softness, moisture wicking, and/or other properties. In addition, a first filament 104 will be introduced and integrated with the staple fiber bundle and the core filament(s) 102, so as to form a part of the wrapping or covering about the core filament 102, helping to bond the fibers of the first filament and that of the stable staple fiber bundle together and about the core filament(s) 102 so that the core filament 102 is substantially contained or encapsulated therein to form the base yarn 112 (FIG. 3).

In some embodiments, an additional or second filament or filaments also can be introduced into and embedded within the base yarn 112. The wrapping staple fibers 106, the core filament(s) 102, and the first filament 104 (and any additional independent filament in some embodiments) will be spun together to form the initial or base yarn that generally will have a twist oriented in a first direction (e.g. an "S" or "Z" direction) as indicated by arrows 310 of FIG. 3. The composite yarn 122 (FIG. 3) further includes one or more additional filaments 108 plied with the base yarn 112 in a subsequent spinning/twisting operation, during which the plied additional fiber is wrapped or twisted about the base yarn at an angle of between about 10° and about 45° (though other angles also can be used), and the composite yarn 122 is subjected to being spun or twisted in a second direction opposite the first direction (indicated by arrows 320 in FIG. 3) to create/apply an opposite direction twist sufficient to substantially balance and/or minimize the torque created in the base composite yarn by the initial spinning operation.

In addition, a fabric can be made from the composite yarns 122 and 222 of FIGS. 1A-3 such as for use in forming protective apparel having enhanced heat and/or cut protection. The fabric such formed may be made of woven or knitted construction. For example, the fabric made from the composite yarns 122 and 222 may be woven in a pattern (i.e. a plain pattern, a twill pattern, a basket pattern, a satin pattern, a leno pattern, a crepe pattern, a dobby pattern, a herringbone pattern, a Jacquard pattern, a pique pattern, a warp pile, or in a weave configuration). In another embodiment, the fabric may be knitted to form articles of clothing, such as a jersey, a rib, a purl, a fleece, a double weft, a tricot, a raschel, a warp knit or a flat knit construction. The resultant fabric can be used to form various performance and/or protective garments.

In a further embodiment, FIGS. 4A and 4B illustrate side views of sections of a first component or yarn 10 and a second component 110 that are combined to form a high performance yarn produced by plying/spinning the second component 110 about the first component 10. As indicated, the first component 10 will include a composite yarn that can be produced according to the present disclosure, with a core filament 12 that includes a material of hardness of about 7.0 or greater on the Mohr hardness scale. In an embodiment, the core filament 12 can include tungsten or an alloy of tungsten, or other similar high hardness materials. Other materials having a hardness of approximately 7.0 Mohs or greater also can be used. The selection of a material of hardness of approximately 7.0 or greater on the Mohs hardness scale is made to achieve certain level of strength, toughness, cut-resistance, and other performance characteristics in the composite yarn formed from the first component 10 and the second component 110 of FIGS. 4A and 4B.

A first sheath of fibers 24 will be applied to the at least one first core filament 12 during a ring jet spinning process. The resulting first component 10 will generally comprise the high hardness core filament 12 having a hardness of at least about 7.0 Mohs and having a sheath of fibers 24 that can be selected from various staple fibers, natural fibers, synthetics or other fibers, wrapped or twisted thereabout. For example, the fibers of the sheath of fibers 24 may include at least one of cotton, nylon, wool, aramids, para-aramids, polyethylene, acrylics, modacrylics, polyesters, carbon fibers.

This first component or yarn 10 further can be plied/twisted and spun with a second component 110. The second component 110, can comprise a filament or a yarn having a core filament 112 formed from a cut resistant material. For example, the second component can comprise a composite yarn having a glass filament core ranging in thickness from about 20 denier to about 3,000 denier, encased within a sheath of fibers 124 that can include similar fibers to those applied to the high hardness core first yarn component 10, and which can be selected to provide additional characteristics or properties such as softness/feel, moisture wicking, static dissipation, etc. For example, the fibers of the sheath of fibers 124 may include aramids, acrylics, modacrylics, polyesters, polypropylenes, nylons, celluloses, silica, graphites, carbon fibers, high density polyethylene, polyamides, polybenzimidazole, co-polymers and blends thereof. Alternatively, the second component can comprise a filament, or a yarn formed from a spun sheath of fibers without a core, and one or more additional synthetic or natural filaments or fibers can be used, including fibers formed from materials selected from aramids, acrylics, melamine-formaldehyde fibers such as Basofil® available from BASF SE of Ludwigshafen, Germany, modacrylics, polyesters, high density polyethylenes (HPPE), such as SPECTRA® e.g., an ultra-high molecular weight polyethylene fiber available from Honeywell International Inc. of Charlotte, N.C.), Dyneema® (e.g., an ultra-high molecular weight polyethylene fiber available from Royal DSM in Heerlen, Netherlands), and Tsunooga® (e.g., a high-molecular-weight polyethylene available from Toyobo Co., Ltd., of Osaka, Japan), polyamides, liquid crystal polyester, liquid crystal polymers such as Vectran™ (e.g., a high-strength polyarylate fiber available from Kuraray Co., Ltd, of Osaka, Japan), linear low density polyethylenes, polypropylenes, nylon, cellulosics, PBI, graphites, and other carbon-based fibers, co-polymers and blends thereof.

As also indicated, during the ring spinning process, the fibers of the first sheath of fibers 24 and the second sheaths of fibers 124 can be substantially intermeshed or entwined to help lock the fibers. As a result, the first component or yarn 10 and the second component 110 can be twisted and spun together with the high hardness core 12 of the resultant high performance composite yarn bound by the glass filament core 112 of the second yarn component 110, with the high hardness core 12 of the composite yarn being substantially encapsulated or encased within a protective covering. This binding and/or locking of the high hardness core 12 within the integrated glass core yarn/fibrous bundle protects the high hardness core filaments 12 and/or fibers while adding further selected or desired performance properties or characteristics to the composite yarn. Thereafter, as the composite yarn is subjected to mechanical stresses during weaving, knitting, needling or other operations to form a performance fabric therefrom, the high hardness core can be protected from becoming engaged and pulled or exposed.

In certain circumstances, it is desirable to form a high performance yarn embodying the principles of the present disclosure with the second yarn component 110 not containing glass filament. In an embodiment, the second yarn component 110 may include one or more metal filaments and one or more nonmetallic filaments. The nonmetallic filaments or fibers can be roughened, textured and/or stretch-broken. Such nonmetallic filaments included in the core of this embodiment may be formed from materials selected from aramids, acrylics, melamine resins such as Basofil® (e.g., a melamine-formaldehyde fiber available from BASF SE of Ludwigshafen, Germany), modacrylics, polyesters, polypropylenes, high density polyethylenes (including ultra-high molecular weight polyethylene fibers such as SPECTRA® fibers available from Honeywell International Inc. of Charlotte, N.C., Dyneema® fibers available from Royal DSM of Heerlen, Netherlands, and Tsunooga® fibers available from Toyobo Co., Ltd., of Osaka, Japan), polyamides, liquid crystal polyesters, liquid crystal polymers such as Vectran™ e.g., a high-strength polyarylate fiber available from Kuraray Co., Ltd, of Osaka, Japan), nylon, rayon, silica, cellulosics, PBI, conductive fibers, graphites and other carbon-based fibers, co-polymers and blends thereof. These nonmetallic filaments may be stretch-broken and/or roughened for other types of care and/or sheath fibers. The sheath of staple fibers 124 thereafter applied to the core of this embodiment generally will be formed of the same materials and be processed according to the same methods described herein for other sheaths.

FIG. 5 is a flowchart illustrating a method 500 of making the composite yarn of FIGS. 1A-4B. The method 500 includes spinning at least one core filament 102 with a series of staple fibers 106 (step 510). The method 500 further includes introducing a first filament 104 during spinning of the series of staple fibers 106 about the at least one core filament 102 (step 520), the series of staple fibers 106 and the first filament 104 combining to form an integrated fibrous bundle. This integrated fibrous bundle wrapped about the at least one core filament 102 to form a base yarn 112 that is spun in a first twist direction, the first filament 104 being applied at approximately the same turns per inch as the series of staple fibers 106. The method 500 further includes a step 530 of plying at least one additional filament 108 or an additional yarn bundle to the base yarn 112 to form a composite 122, and spinning the at least one additional filament 108 in a second twist direction opposite the first twist direction.

Test Results:

An abrasion/cut resistant fabric formed using the composite yarns formed according to the principles and methods of the present disclosure, formed from a series of short staple fibers wrapped and spun about a glass filament core and including a filament of high density polyethylene wrapped about and integrated with the staple fibers spun about the core (referred to as "Sample A" below), were tested against abrasion/cut resistant fabrics formed using an existing abrasion resistant yarns having short staple fibers spun about a glass core (referred to as "Sample B" below). For the testing, the sample fabrics used included:

Sample A: Fabric weight—441 G/M$^2$ woven with spun core yarns composed of:

32% HPPE Filament
24% Polyester Filament
16% Fiberglass
14% HPPE Staple Fiber
14% Nylon Staple Fiber Sample B: Fabric weight—569 G/M$^2$ woven with a spun core yarn composed of:

46% Nylon Staple Fiber
30% HPPE Staple Fiber
17% Fiberglass Filament
7% Polyester Filament In a first series of tests, the fabrics of Sample A and Sample B were subjected to Abrasion Resistance Testing of Textile Fabrics according to ASTM D3884: wherein multiple samples of each fabric were tested, with each sample mounted on a rotary turntable of a Tabor Abrasion Wheel Testing device (Type H-18) with a 500-gram weight applied thereto, and subjected to wearing action applied by a pair of abrasive wheels applied at consistent pressures. The results of the testing were as follows:

Fabric Sample A—Avg. resistance to abrasion=3,585 cycles
Fabric Sample B—Avg. resistance to abrasion=431 cycles The abrasion resistant fabrics formed using the yarns produced according to the present disclosure thus exhibited an approximate increase in resistance to abrasion of about 731.8%.

In a second series of tests, fabrics of Sample A and Sample B also were subjected to Cut Resistance Testing in accordance with ASTM F2992/F2992M-15 Standard Testing for Measuring Cut Resistance of Materials Used in Protective Clothing. In such testing, the fabrics of samples A and B were place in a holder and subjected to cutting via a razor blade drawn along/across each sample. The tests were repeated with a differing weight/load applied to the razor blade for each test run. The results of the testing were as follows:

Fabric Sample A—Avg. cut resistance=A5 (>2200 grams, a "Job Risk Factor" of Med./High)
Fabric Sample B—Avg. cut resistance=A4 (>1500 grams, a "Job Risk Factor" of Med.)

It is thus seen that the fabrics (Sample A) formed using the composite yarns produced according to the present disclosure exhibit a significant increase in both abrasion resistance and cut resistance over fabrics formed using existing cut/abrasion resistant yarns.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A composite yarn, comprising:

a base yarn, comprising a core filament and a fibrous bundle, the fibrous bundle comprising a series of sheath fibers and at least a first filament, wherein the fibrous bundle is spun or twisted about the core filament, wherein the first filament is introduced during spinning of the series of sheath fibers about the core filament such that the first filament and the sheath fibers form an integrated filament and fibrous bundle that is twisted about the core filament sufficient to substantially lock and bind the core filament within the integrated filament and fibrous bundle, and wherein, the first filament being twisted with the sheath fibers about the core filament at approximately the same turns per inch as the sheath fibers to produce the base yarn with a first twist direction; and at least one additional filament or additional yarn plied and twisted with the base yarn, wherein the at least one additional filament or additional yarn is twisted in a second twist direction opposite the first twist direction sufficient to substantially minimize torque in the composite yarn;

wherein the core filament comprises steel, stainless steel, aluminum, tungsten, and alloys thereof, glass, high density polyethylene, high density polypropylenes, high-strength polyarylate, silica, para-aramids, polypropylene, or liquid crystal polyesters.

2. The composite yarn of claim 1, the first filament is applied at a substantially equivalent number of turns per inch as a number of turns per inch in the fibrous bundle.

3. The composite yarn of claim 1, wherein the fibers of the fibrous bundle comprise para-aramids, meta-aramids, modacrylics, opan, high density polyethylene, nylons, polyesters, polypropylenes, cellulosics, rayon, silica, wool, cotton, acrylic, carbon fibers, polyamides, metals, liquid crystal polymers, linear low density polyethylenes, PTT, PBI, or blends thereof.

4. The composite yarn of claim 1, wherein the at least one additional filament or additional yarn comprises polyester, nylon, lycra, para-aramids, high density polyethylene, high-strength polyarylate, PTT, PBI, polypropylene, rayon, wool, carbon fibers, polyamides, stainless steel, cotton, modacrylic, or combinations thereof.

5. The composite yarn of claim 1, wherein the core filament forms between about 10% and about 60% of a mass of the composite yarn by linear weight.

6. The composite yarn of claim 1, wherein the at least one additional filament forms between about 3% and about 55% of a mass of the composite yarn by linear weight.

7. The composite yarn of claim 1, wherein a fabric formed from the composite yarn is used in protective apparel for heat and/or cut protection.

8. The composite yarn of claim 7, wherein the fabric is made of woven or knitted construction.

9. The composite yarn of claim 8, wherein the fabric is woven in a pattern comprising a plain pattern, a twill pattern, a basket pattern, a satin pattern, a leno pattern, a crepe pattern, a dobby pattern, a herringbone pattern, a Jacquard pattern, a pique pattern, a warp pile, or a weave configuration.

10. The composite yarn of claim 8, wherein the fabric includes a knit fabric comprising a jersey, a rib, a purl, a fleece, a double weft, a tricot, a raschel, a warp knit or a flat knit construction.

11. A composite yarn, comprising:

a first component comprising at least one first core filament formed of a material having a hardness of at least approximately 7.0 on the Mohs hardness scale, a first sheath of fibers spun about the at least one first core filament, and a first filament introduced during spinning of the first sheath of fibers about the core so as to be twisted about the core sufficient to substantially lock the core within the first sheath of fibers; and a second component comprising a core and a second sheath of fibers applied about the core; and wherein the first component is ring spun with the second component to form the composite yarn having the first yarn component as the core of the composite yarn with the second yarn component twisted thereabout.

12. The composite yarn of claim 11, wherein the at least one first core filament comprises a tungsten or tungsten alloy.

13. The composite yarn of claim 11, wherein the fibers of the first sheath of fibers comprise at least one of cotton, nylon, wool, aramids, para-aramids, polyethylene, acrylics, modacrylics, polyesters, carbon fibers.

14. The composite yarn of claim 11, wherein the first sheath and the second sheath of fibers comprise fibers of aramids, acrylics, modacrylics, polyesters, polypropylenes, nylons, celluloses, silica, graphites, carbon fibers, high density polyethylene, polyamides, polybenzimidazole, co-polymers or blends thereof.

15. The composite yarn of claim 11, wherein the core of the second component comprises glass, steel, tungsten, and aramids.

* * * * *